United States Patent [19]

Tarassoff

[11] Patent Number: 4,641,585

[45] Date of Patent: Feb. 10, 1987

[54] TERMINAL FOR A DETACHABLE GRIP CHAIRLIFT FOR GONDOLA LIFT

[75] Inventor: Serge Tarassoff, Fontaine, France

[73] Assignee: Pomagalski, S.A., Fontaine, France

[21] Appl. No.: 604,144

[22] Filed: Apr. 26, 1984

[30] Foreign Application Priority Data

May 2, 1983 [FR] France ..... 83 07397

[51] Int. Cl.[4] ..... B61B 11/00; B61B 9/00

[52] U.S. Cl. ..... 104/173.2; 104/211

[58] Field of Search ..... 104/173 ST, 178, 179, 104/196, 211, 173.8, 168; 105/329 S, 329 SC

[56] References Cited

U.S. PATENT DOCUMENTS

| | | | |
|---|---|---|---|
| 3,417,710 | 12/1968 | Kokes | 104/173 R |
| 3,538,855 | 11/1970 | Cyr | 104/173 ST |
| 3,585,940 | 6/1971 | Hancock | 104/173 R |
| 3,868,907 | 3/1975 | Schippers | 104/173 R |
| 4,050,385 | 9/1977 | Gurr et al. | 104/173 ST |
| 4,210,019 | 7/1980 | Laurent | 104/179 X |

FOREIGN PATENT DOCUMENTS

| | | | |
|---|---|---|---|
| 674673 | 11/1963 | Canada | 104/173 ST |
| 412609 | 1/1923 | Fed. Rep. of Germany . | |
| 2496029 | 12/1980 | France . | |
| 476592 | 5/1970 | Switzerland . | |

*Primary Examiner*—Robert B. Reeves
*Assistant Examiner*—Glenn B. Foster
*Attorney, Agent, or Firm*—Parkhurst & Oliff

[57] ABSTRACT

The invention relates to a detachable grip chairlift or gondola lift terminal having a transfer rail extending between the downhill run and the uphill run of the cable. The chair trucks run at slow speed along the transfer rail which comprises a movable rail section extending along the loading and/or unloading area. The level of the movable rail section may be adapted in accordance with the snow level on this area for properly positioning the chairs.

5 Claims, 4 Drawing Figures

TERMINAL FOR A DETACHABLE GRIP CHAIRLIFT FOR GONDOLA LIFT

BACKGROUND OF THE INVENTION

1. Field of the Invention

The invention relates to a terminal of an overhead transporter with a continuously moving endless cable, in particular a detachable-grip chairlift or gondola lift. The following description relates to a chairlift but the terminal according to the present invention is adapted to be employed in any monocable or bicable aerial ropeway equipped with chairs, cars or nacelles.

2. Description of the Prior Art

U.S. Pat. No. 3,931,766 describes a chairlift terminal which can be installed outside, the whole of the mechanism being suspended on a steel framework, freeing a large area on the ground underneath the return sheave. Such a structure greatly facilitates the mechanical removal of the snow on this area, but this operation must be carried out again after each heavy fall of snow. It has already been proposed to secure the whole mechanism on an adjustable support and to adjust the height with the build up of snow.

The mechanism comprises the return sheave, the drive motor and the detachable grip couplinf and uncoupling systems and the arrangement for lifting or lowering this heavy mechanism presents a number of problems.

SUMMARY OF THE INVENTION

It is an object of the present invention to provide a terminal which may be easily adapted to the snow level height, so that the skiers can still be safely and efficiently loaded or unloaded without the necessity of removing the snow.

In accordance with the present invention, the chairs are supported by trucks which are disconnected from the cable in the station and run at slow speed on a transfer rail. The transfer rail section located at the loading or unloading area is supported by lifting jacks for vertically shifting and properly positioning this section in accordance with the snow level.

The cable return sheave, the drive motor and the acceleration and/or deceleration devices are rigidly secured to support towers at a sufficient height level for the free passage of the chairs at all times. It is clear that the chair must be in the right position for permitting the skiers to sit down on the chair when it comes into contact with the skiers.

The movable rail section will be connected to the fixed rail sections at the entrance and the exit of the station by means of downwardly and upwardly inclined rail sections. These inclined sections are pivotally connected to the adjacent sections for permitting a slope variation.

An endless drive chain extends along the transfer rail for driving the chair trucks, disconnected from the cable at a slow speed in the station, which may be a loading station and/or an unloading station.

BRIEF DESCRIPTION OF THE DRAWINGS

Other objects and advantages of the invention will be apparent from the following description with reference to the accompanying drawings wherein.

Figure 1:
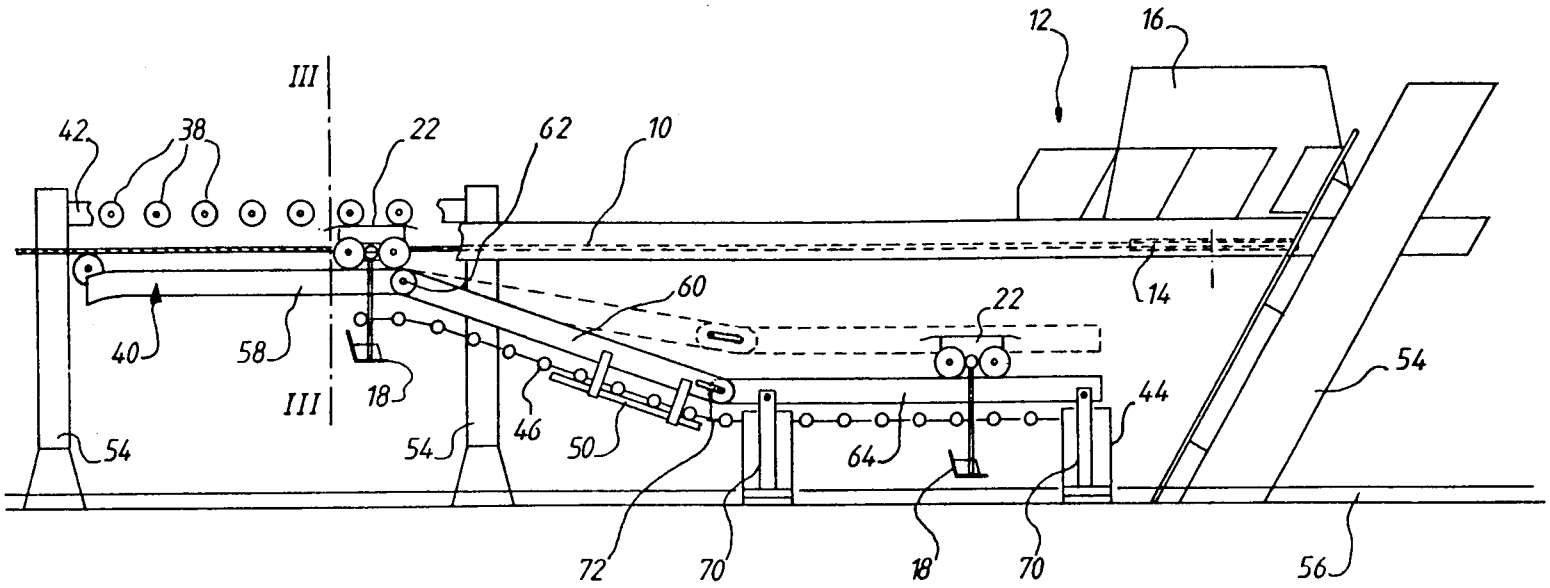
FIG. 1 is a schematic view in elevation of a chairlift terminal.
Figure 2:
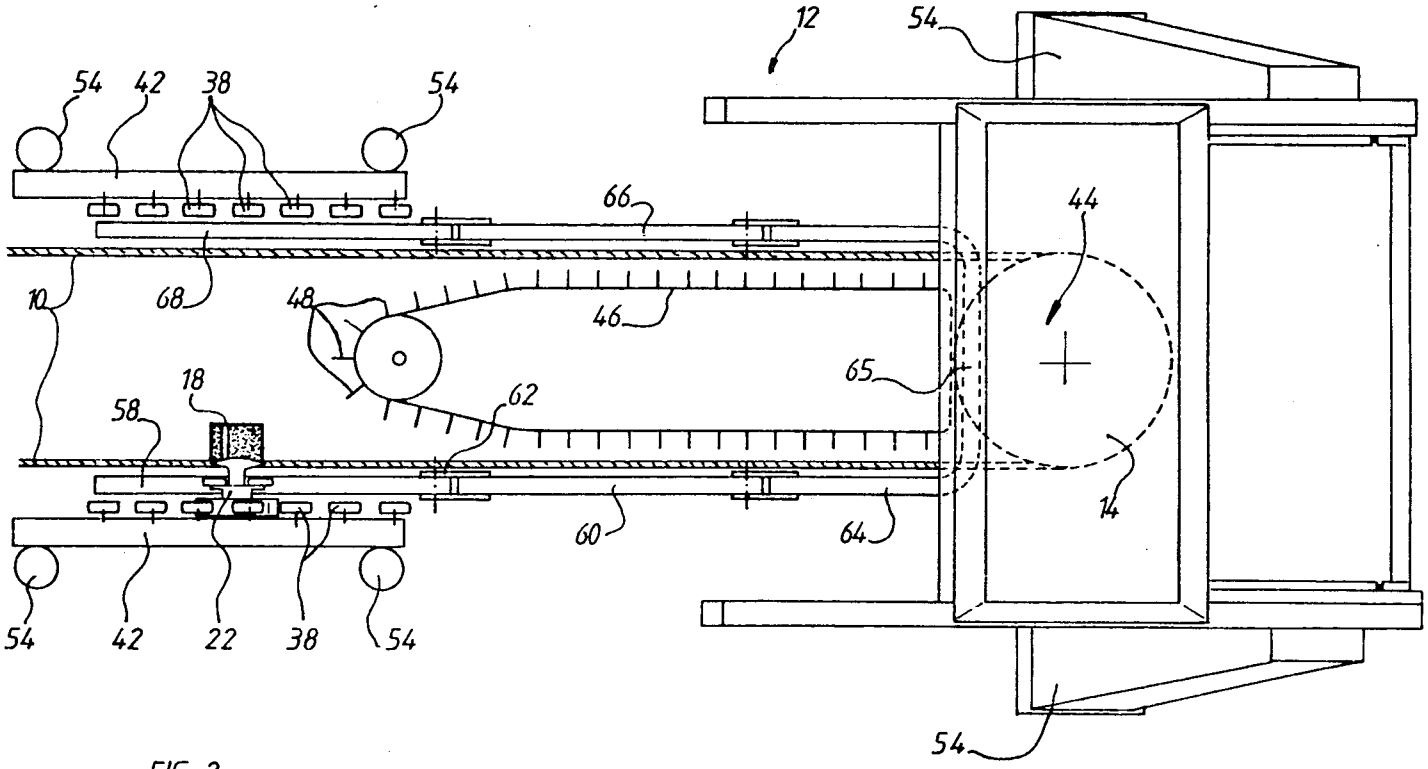
FIG. 2 is a plan view of the terminal shown in FIG. 1.
Figure 3:
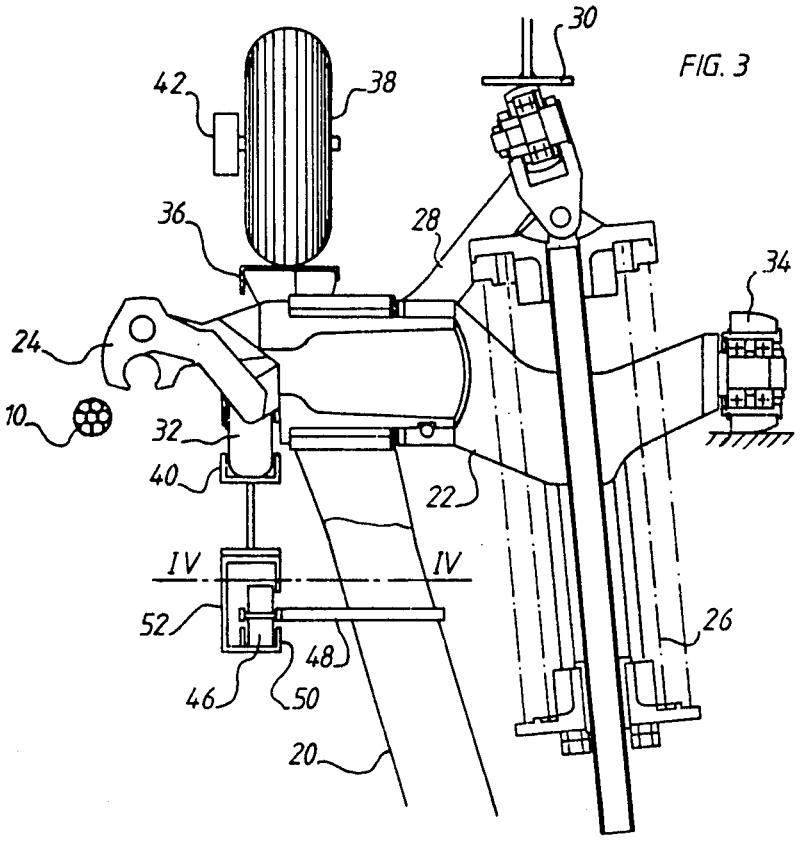
FIG. 3 is a sectional view taken along the line III—III of FIG. 1.
Figure 4:
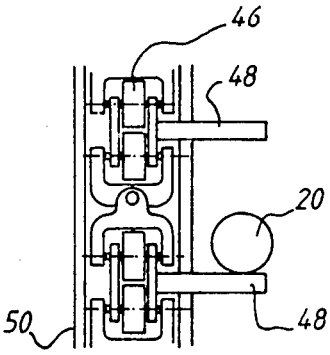
FIG. 4 is a sectional view taken along the line IV—IV of FIG. 3.

In these figures an aerial cable 10 of a monocable chairlift passes through a terminal 12 over a terminal return sheave 14 driven by a motor 16. The terminal is a starting or an arrival station. Chairs 18 are suspended from trucks 22 by means of a suspension tube 20. The truck 22 includes a detachable coupling grip 24 with a grip actuating lever 28 and support wheels 32, 34, riding upon a transfer or shunt rail 40 in the station. A spring 26 biases the grip 24 towards the closed position and causes it to grip the cable 10. A grip release and actuator 30 is located adjacent the transfer rail 40 for engaging the grip lever 28 respectively at the station entrance to release the grip 24 from the cable 10 and at the station exit to couple the grip 24 on the cable 10. The truck 22 includes a drive plate 36 which cooperates with friction driving wheels 38. The grip 24 may be of the type described in the U.S. Pat. No. 4,441,450.

A train of driving wheels 38 are fixed to a support beam 42 which extends along a deceleration section of the transfer rail 40, located at the entrance of the station after the grip release 30. The wheels 38 decelerate the truck 22 uncoupled from the cable 10 and the decelerated truck 22 is then advanced and driven along the rail 40 by means of an endless drive chain 46 with drive arms 48. The rail 40 forms a loop track extending between the downhill and the uphill runs of the cable 10 and passing along a loading area 44 and/or an unloading area. The endless chain 46 moves the truck 22 at a low speed for convenient loading and/or unloading of the chairs 18 and the chain 46 is guided by means of a U-shaped rail 50 rigidly secured to the rail 40 by means of brackets 52. The links of the chain 46 include axes which are perpendicular for following the loopshaped track. At the exit of the station the truck 22 is accelerated by the friction wheels 38 at a speed synchronized with the speed of the cable 10 before gripping of this cable when the grip 24 is engaged by the grip actuator 30. Such deceleration and acceleration systems are for instance described in U.S. Pat. No. 4,210,019. The detachable-grip chairlift permits a high operating speed, the chair being moved very slowly when the skiers or passengers alight.

The motor 16, the return sheave 14 and the beams 42 are rigidly secured to towers 54 which are high enough for the free passage of the chairs whatever the snow accumulation is.

In accordance with the present invention, the rail 40 includes several sections. A first section 58 at the station entrance, which extends along the length of the friction wheels train 38. A second downwardly inclined section 60 having one end 62 pivotally linked to the end of the first section 58 and the other end to a third section 64. This third section 64 is substantially horizontal and includes the return loop 65 in the loading or unloading area 44. The following fourth upwardly inclined section 66 extends symetrically to the second section 60 and is pivotally linked to the fifth acceleration section 68 which is similar and parallel to the first deceleration section 58. The third loading section 64 is secured to lifting jacks 70 for instance hydraulic jacks bearing upon the ground or the framework fixed to the towers 54. The position, in particular the level of the third section 64, may be adapted to the snow level for properly positioning this section 64 so that the chairs are in the right position for the loading or unloading of the skiers. The lifting jacks 70 are power supplied in synchronism for maintaining the third section horizontal, an intermediary position being shown in dotted line on FIG. 1. The links between the third section and the second and fourth sections comprise slots 72 which permit a relative shifting and pivotal movement. The chain 46 supported by the rail 40 follows the movement of the third section 64, a take-up device (not shown) straining the chain 46. The chain 46 may comprise several successive sections or may be replaced by any suitable conveyor or truck drive device.

It is unnecessary to describe the functioning of the terminal which is evident from the above account and it suffices to recall that the level of the third rail section 64 is adjusted after each snow fall to the right position for the loading or unloading of the skiers. It is clear that the third section 64 may be linear and/or moved by means of mechanical jacks such as screws.

I claim:

1. A terminal for an aerial ropeway, in particular a chairlift or a gondola lift, having an endless continuously moving cable extending along uphill and downhill runs, and trucks with detachable grips for selectively coupling the chairs or gondolas to said cable, the terminal comprising:

a cable return sheave, a transfer rail extending in the terminal between the uphill and the downhill runs of the cable, said trucks being uncoupled from the cable in the terminal and running on said transfer rail, a grip release located at the entrance of the terminal adjacent said transfer rail for actuating a detachable grip to uncouple a truck from said cable, said transfer rail including successively a first section located at a first level adjacent the entrance of the terminal and having decelerating means for decelerating the truck uncoupled from the cable, a second section inclined downwardly relative to said first level, a third substantially horizontal adjustable section located at a second level, a fourth section inclined upwardly relative to said first level, and a fifth section located at the first level adjacent the exit of the terminal and having accelerating means for accelerating the truck uncoupled from the cable to synchronize the speed of the truck with the speed of the cable, a grip actuator located at the exit of the terminal adjacent said transfer rail for actuating said detachable grip to couple the truck onto the cable, truck drive means for driving the truck along the transfer rail at slow speed, a loading and/or unloading area located along said third horizontal section, a framework on which said return sheave, said first and fifth sections, said grip release and said grip actuator are rigidly secured at said first level for the free passage of the chairs or gondolas therebelow regardless of the snow level in said terminal, and lifting means linked to said third section for adjusting said second level of the third section relative to the first level in accordance with the snow level at said loading and/or unloading area.

2. The terminal according to claim 1, wherein said downwardly inclined section is pivotally linked to said first and third sections and said upwardly inclined section is pivotally linked to said third and fifth sections so that the slope of said inclined sections varies with the level adjustment of said third section.

3. The terminal according to claim 1, wherein said lifting means comprises lifting jacks having a power supply means for lifting in synchronism said third section.

4. The terminal according to claim 1, wherein said truck drive means comprises a drive chain extending along and secured to said transfer rail.

5. The terminal according to claim 1, wherein said third section includes a loop-shaped rail section.

* * * * *